US007021748B2

(12) United States Patent
Fujii et al.

(10) Patent No.: US 7,021,748 B2
(45) Date of Patent: Apr. 4, 2006

(54) INK JET HEAD SUBSTRATE, INK JET HEAD USING THE SUBSTRATE, AND INK JET PRINT APPARATUS

(75) Inventors: Yasuo Fujii, Kanagawa (JP); Takashi Morii, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/619,577

(22) Filed: Jul. 16, 2003

(65) Prior Publication Data

US 2004/0021739 A1 Feb. 5, 2004

(30) Foreign Application Priority Data

Jul. 19, 2002 (JP) ..... 2002-211009

(51) Int. Cl.
*B41J 2/05* (2006.01)

(52) U.S. Cl. ..... 347/59; 347/62

(58) Field of Classification Search ..... 347/9–13, 347/57, 59

See application file for complete search history.

(56) References Cited

U.S. PATENT DOCUMENTS

| | | | | |
|---|---|---|---|---|
| 5,371,395 | A * | 12/1994 | Hawkins | 257/361 |
| 5,532,901 | A * | 7/1996 | Hawkins et al. | 361/212 |
| 6,243,111 | B1 | 6/2001 | Imanaka et al. | 347/13 |
| 6,375,295 | B1 * | 4/2002 | Ghozeil et al. | 347/12 |

OTHER PUBLICATIONS

Mano, Digital Design, 1991, Prentice Hall, 2nd ed., p. 59.*

* cited by examiner

*Primary Examiner*—Thinh Nguyen
(74) *Attorney, Agent, or Firm*—Fitzpatrick, Cella, Harper & Scinto

(57) ABSTRACT

There is provided an ink jet head substrate which can sufficiently suppress generation of noises at the time when heating elements are driven, and which can be constituted small in size. In an ink jet head substrate including a plurality of heating elements, a power transistor for driving the heating elements according to image data, an input pad of a heat pulse (pulse width regulating signal) for regulating a width of a drive pulse to be applied to the heating elements, and a block selection unit for dividing the plurality of heating elements into blocks for a predetermined number of heating elements to drive the heating elements in a time division manner with the divided block as a unit, a delay circuit group consisting of a logic circuit (delay circuit) for supplying a drive pulse, which is applied to the heating elements in a selected block, at staggered timing is provided in a line of a heat pulse.

8 Claims, 7 Drawing Sheets

INK JET HEAD SUBSTRATE, INK JET HEAD USING THE SUBSTRATE, AND INK JET PRINT APPARATUS

BACKGROUND OF THE INVENTION

1. Field of the Invention

The present invention relates to an ink jet head substrate capable of performing stable printing with reduced malfunctions with respect to noises, an ink jet head using this ink jet head substrate, and an ink jet print apparatus such as a printer using this ink jet head.

2. Related Background Art

An ink jet recording method (liquid jet recording method) is extremely excellent, for example, in that generation of noises at the time of operation is negligibly very small and that high-speed recording is possible and recording on so-called plain paper can be performed without requiring special processing of fixing. Thus, the ink jet recording method has become a mainstream of a print system recently. In particular, in an ink jet head utilizing thermal energy, thermal energy generated by a heating element (electrothermal converting element; heater) is given to a liquid, whereby a foaming phenomenon is selectively caused in the liquid, and ink liquid droplets are discharged from discharge ports by energy of the foaming. In such an ink jet head, for improvement of recording density (resolution), a large number of fine heating elements are arranged on a silicon semiconductor substrate and discharge ports are further arranged so as to be opposed to the heating elements, respectively. In addition, a drive circuit and peripheral circuits for driving the heating elements are also provided on the silicon semiconductor substrate. The silicon semiconductor substrate with the heating elements, the drive circuit, and the peripheral circuits provided thereon in this way is called an ink jet head substrate. For example, there is a tendency to provide, within an identical silicon semiconductor substrate, several tens to several thousands of heating elements, drivers corresponding to each of the heating elements, a shift register with the same number of bits as the number of heating elements for sending respective image data, which are inputted serially, to the drivers in parallel with each other, and a latch circuit for temporarily storing data, which are outputted from the shift register, for each heating element.

As described above, recently, integration of logic circuits such as a driver, a shift register, and a latch on a head substrate has been advanced. However, a current pulse flowing to one heating element instantaneously reaches a relatively high current value and, in the case in which the number of heating elements to be simultaneously turned ON (i.e., the number of discharge ports from which ink droplets are simultaneously discharged) is large, for example, a pulse-like current in the order of one to several amperes flows to a power supply line for driving the heating elements and a ground (GND) line.

Since such a pulse-like large current flows, there arises such a fear that the logic circuit section on the head substrate malfunctions due to noises caused by inductive coupling generated in flexible wiring from a printer apparatus main body to an ink jet head, wiring in the ink jet head, or the like. In addition, radiation of unnecessary electromagnetic noises to the outside of the printer apparatus is also concerned.

A level of inductive noises becomes higher as an amount of change of current per a unit time increases. Thus, as the number of discharge ports provided in the ink jet head is increased for high-speed or high-precision printing or the like, it is expected that the number of elements which are simultaneously turned ON increases and a current value of current pulses further increases as well. Accordingly, a noise level becomes higher.

Therefore, instead of driving the large number of discharge ports provided on the head substrate simultaneously, these discharge ports are divided into a plurality of blocks, and driving by a unit of block is performed. That is, at certain timing, the heating elements are selectively driven in a first block and no heating element is driven in the remaining blocks. At the next timing, the heating elements are selectively driven in a second block and no heating element is driven in the remaining blocks. The heating elements in subsequent blocks are driven in the same manner, whereby driving of the heating elements corresponding to all the discharge ports is completed once.

However, in the case in which there are a large number of discharge ports, a magnitude of a current pulse cannot be reduced simply by dividing the discharge ports into an appropriate number of blocks, and an amount of generation of inductive noises cannot be suppressed. It is also possible that the number of heating elements which are simultaneously turned ON is reduced by increasing the number of blocks. However, in such a case, there is a fear in that a time allocated to one block is reduced and sufficient energy for ink discharge cannot be obtained.

Thus, U.S. Pat. No. 6,243,111 discloses a configuration for shifting a drive pulse, which is applied to heating elements belonging to an identical block, little by little for each heating element. That is, in forming an ink jet head substrate, a hysteresis circuit is provided in an input section together with components for a logic discharge control circuit such as heating elements, a driver, and a shift register and, at the same time, a CR (capacitor resistor) integrating circuit is formed in a signal path for a heat pulse (input pulse width signal), which regulates a pulse width and timing of a drive pulse, such that the drive pulse is applied to different heating elements at staggered timing. Consequently, the heat pulse is delayed to drive the respective heating elements sequentially. In this way, timing of the heat pulse is staggered using the CR integrating circuit, and a current flowing to the heating elements is controlled, whereby the number of heating elements which are turned ON at exactly the same timing is reduced, and a peak value of a current or a rising ratio of a current due to the drive pulse is reduced to suppress generation of noises. Consequently, even if there is increase in the number of heating elements which are driven simultaneously due to increase in the number of discharge ports or high-density implementation of discharge ports indispensable for high-speed printing, generation of inductive noises or the like can be suppressed.

However, in the case in which generation of noises is suppressed by using the CR integrating circuit as disclosed in U.S. Pat. No. 6,243,111, if there are fluctuations in C (capacitance) and R (resistance), a product of the fluctuations results in a fluctuation in a delay value of the heat pulse. Thus, a current flowing to the heating elements cannot be controlled with high accuracy and, as a result, generation of noises cannot be suppressed sufficiently. In addition, since the CR integrating circuit is constituted by an input buffer, a capacitor, and a resistor, when a difference of a wiring pattern length to a logic circuit input of the next stage increases, the delay value fluctuates. In addition, in the head substrate which is typically manufactured using a silicon semiconductor device manufacturing technique, a gate oxide film is often used for a capacitor and a diffused resistor is often used as a resistor. When it is intended to constitute a CR integrating circuit having a desired time constant, the capacitor and the resistor occupy a large area on the head substrate, and the head substrate is enlarged.

Therefore, it is an object of the present invention to provide an ink jet head substrate which can sufficiently suppress generation of noises and can be constituted small in size, an ink jet head using such a substrate, and an ink jet print apparatus.

SUMMARY OF THE INVENTION

According to the present invention, there is provided an ink jet head substrate having a plurality of heating elements and an input line for inputting a pulse width regulating signal regulating a width of a drive pulse to be applied to the heating elements on a base substrate, characterized in that a logic circuit for supplying the drive pulse to be applied to the heating elements at staggered timing is provided on a line for a pulse width regulating signal.

In the present invention, as the above-mentioned logic circuit, a delay circuit is preferably used, in which CMOS inverter circuits of even number stages are connected.

An ink jet head of the present invention is characterized by including an ink jet head substrate according to the present invention and a member which is combined with the ink jet head substrate and forms liquid paths relating to the heating elements and ink discharge ports forming one end of the liquid paths.

An ink jet print apparatus of the present invention is characterized by including an ink jet head according to the present invention and means for conveying a print medium relatively to the ink jet head.

Other features advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENT

Figure 1:
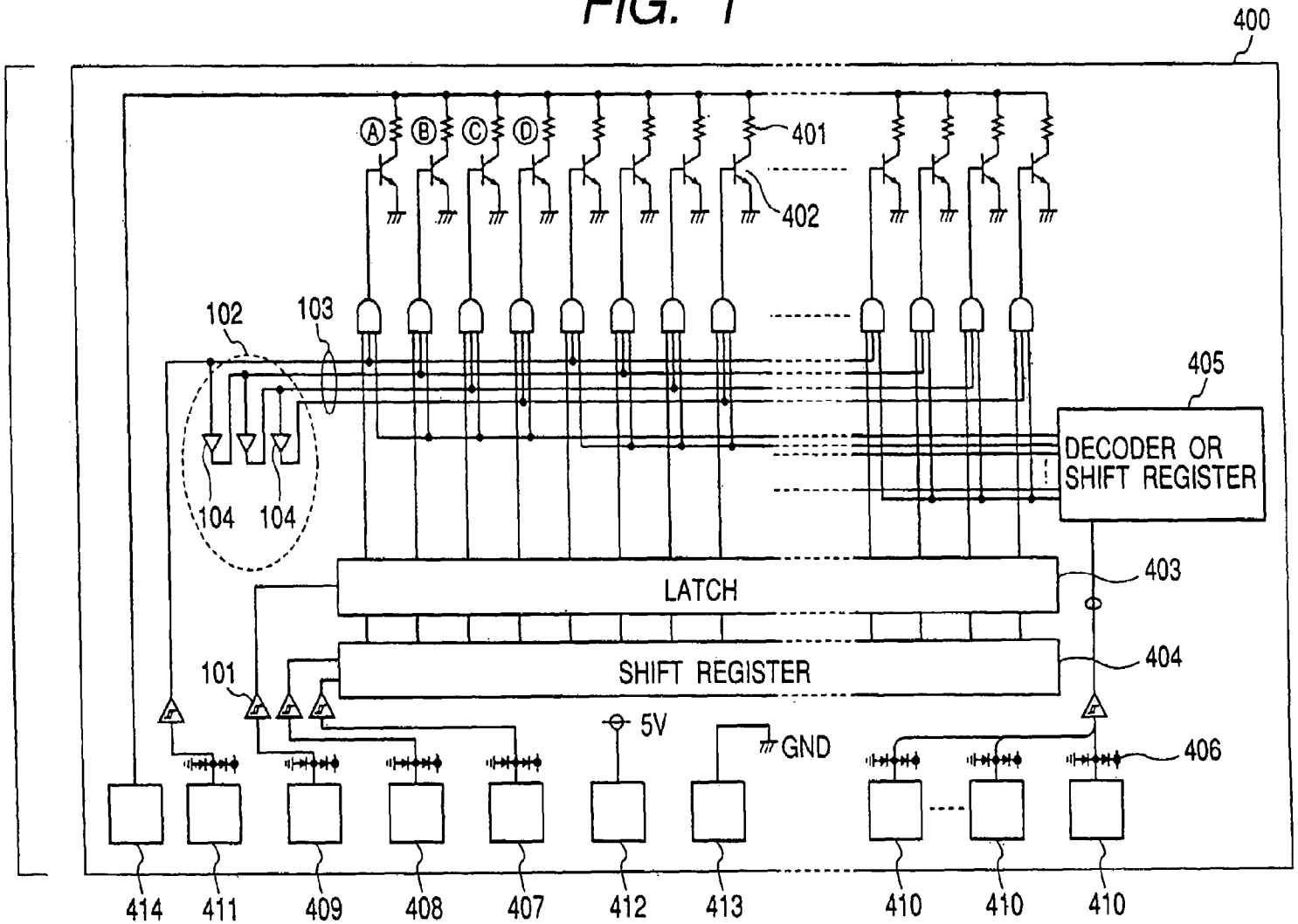
FIG. 1 is a circuit diagram of an ink jet head substrate of an embodiment of the present invention.

Next, a preferred embodiment of the present invention will be described with reference to the accompanying drawings. FIG. 1 is a diagram showing a circuit structure of an ink jet head substrate of an embodiment of the present invention.

The logic circuit means the circuit which determines the output signal, according to an input signal. That which consists of the diode and the transistor is called DTL (Diode-Transistor Logic), and that which composed of the transistor instead of the diode is called TTL (Transistor-Transistor Logic).

In FIG. 1, a large number of heating elements 401 are provided on a substrate 400. One ends of the heating elements 401 are commonly connected to a heating element drive power supply and the other ends thereof are respectively grounded via a power transistor 402 provided for each heating element 401. The power transistors 402 function as switches for the heating elements 401. A latch circuit 403 and a shift register 404 are provided on the substrate 400. Moreover, for example, for the purpose of miniaturizing a printer main body power supply device by reducing the number of heating elements 401 to be driven simultaneously to thereby reduce a current instantaneously flowing, a group of heating elements are divided into blocks each having a predetermined number of heating elements, and a time division drive block selecting logic 405 such as a decoder to be provided in order to perform division driving in unit of blocks, a logic system buffer 101 having a hysteresis characteristic, and the like are formed on the substrate 400. In addition, as shown in the figure, electrostatic protective elements 406 may be provided. Input signals include a clock for moving the shift register, an image data input for receiving image data serially, a latch clock for holding data in the latch circuit, a block enable signal for block selection, and a logic signal which is a heat pulse for controlling an ON time of the power transistor, that is, a time during which the heating elements are driven, from the outside, as well as a logic circuit drive power supply (5V), a ground (GND) line, and a heating element drive power supply. These input signals are inputted via pads 407, 408, 409, 410, 411, 412, 413, and 414 on the substrate, respectively. Moreover, there is provided an AND circuit for calculating AND of a heat pulse, an output of the latch circuit 403, and an output from the decoder 405 for each power transistor 402, and controlling the power transistor 402 according to a result of the calculation to allow a drive pulse to flow through the heating element 401.

Figure 6A:
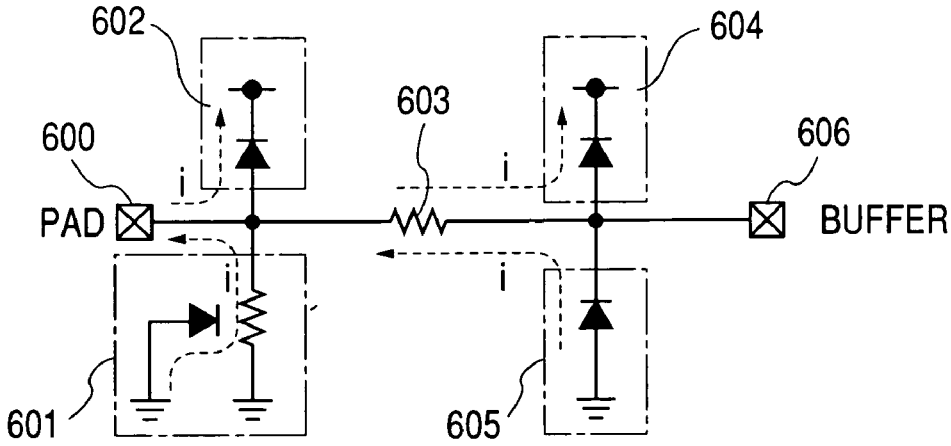
FIGS. 6A and 6B are equivalent circuit diagrams of an electrostatic protective element shown in FIG. 1.
Figure 6B:
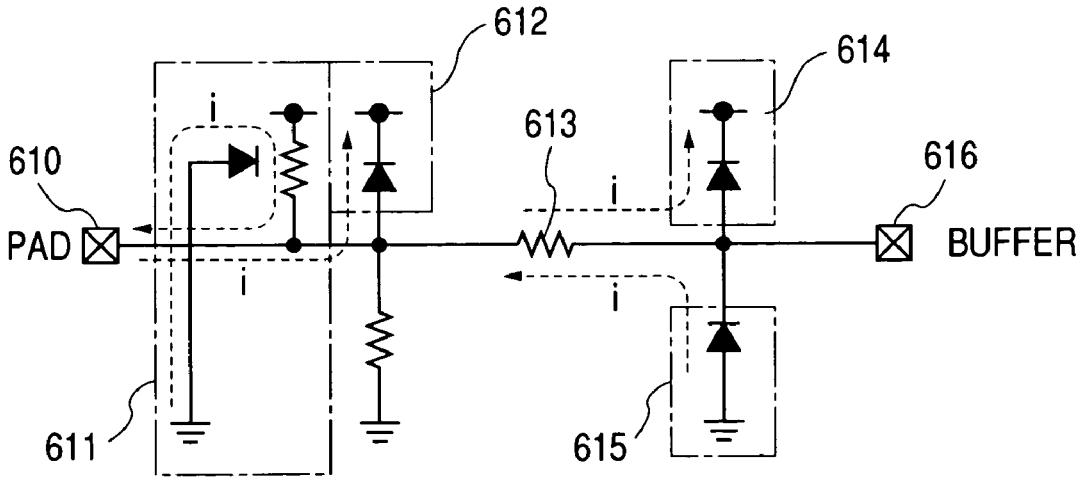
Figure 7A:
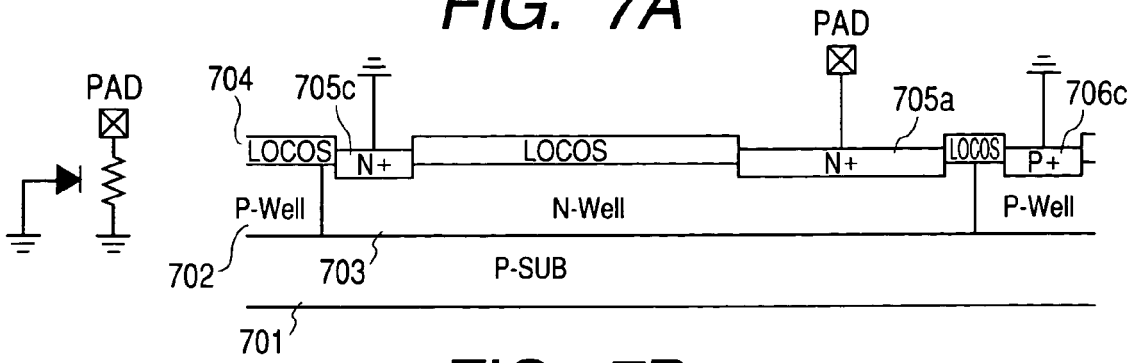
FIGS. 7A, 7B, 7C, and 7D are film diagrams of the electrostatic protective element shown in FIGS. 6A and 6B.
Figure 7B:
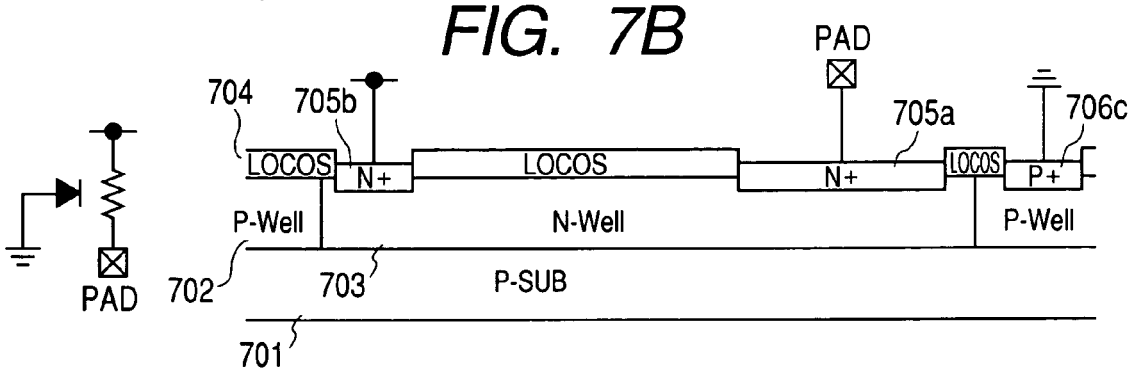
Figure 7C:
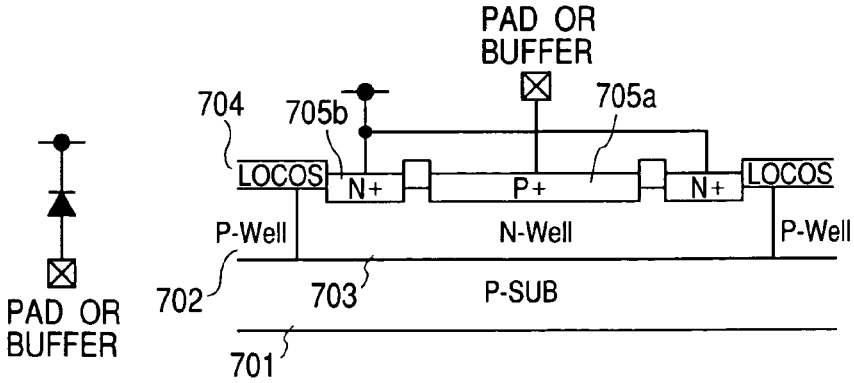
Figure 7D:
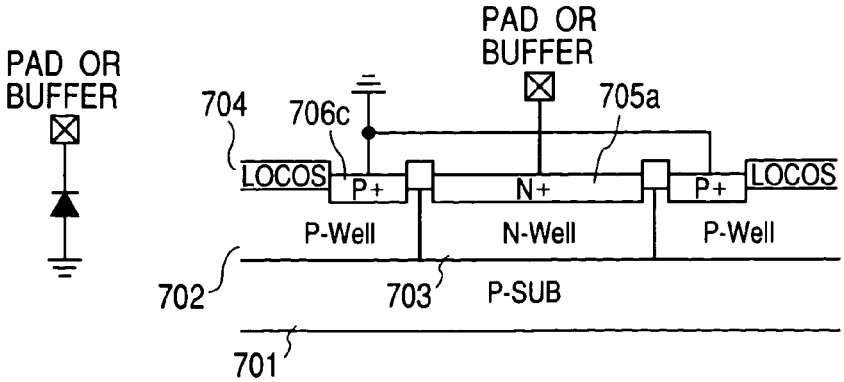

Here, equivalent circuits of the electrostatic protective elements 406 are shown in FIGS. 6A and 6B, and film structures thereof are shown in FIGS. 7A to 7D. Although not shown in FIG. 1, the protective elements 406 are constituted by a circuit form of FIG. 6A provided with a pull-down resistor or a circuit form of FIG. 6B provided with a pull-up resistor. In FIGS. 6A and 6B, reference numeral 600 (610) denotes a pad equivalent to the pad on the substrate of FIG. 1; 606 (616), a buffer equivalent to logic system buffer 101 of FIG. 1; and 601 (611), a pull-down resistor (pull-up resistor) provided with a parasitic diode for electrostatic protection between ground (GND) lines. Reference numerals 602 (612) and 604 (614) denote diodes for electrostatic protection connected to a logic circuit drive power supply (5V) line; 605 (615), a diode for electrostatic protection connected to the ground (GND) line; and 603 (613), a polysilicon resistor. Dotted lines shown in FIGS. 6A and 6B indicate paths through which a current in the case of being electrostatically discharged to the pad 600 (610) flows. As can be seen from this, between the pad 600 (610) and the polysilicon resistor 603 (613), a path defined by the parasitic diode 601 (611) connected to the ground (GND) line composed of the pull-up resistor or the pull-down resistor and the diode 602 (612) connected to the logic circuit drive power supply (5V) is formed. In addition, between the polysilicon resistor 603 (613) and the buffer 606 (616), a path defined by the diode 605 (615) connected to the ground (GND) line and the diode 604 (614) connected to the logic circuit drive power supply (5V) is formed. FIGS. 7A to 7D are diagrams showing film structures in which each component of FIGS. 6A and 6B are shown. FIG. 7A shows the pull-down resistor 601 with a parasitic diode, FIG. 7B shows the pull-up resistor 611 with a parasitic diode, FIG. 7C shows the diodes 602 (612) and 604 (614) connected to the logic circuit drive power supply (5V), and FIG. 7D shows the diode 605 (615) connected to the ground (GND) line. In FIG. 7A, reference numeral 701 denotes a P-type silicon substrate; 702, a P-type well area; 703, an N-type well area; 704, a field oxide film; and 705*a*, 705*c*, and 706*c* (705*b* shown in FIGS. 7B and 7C), a high concentration N-type area and a high concentration P-type area for taking ohmic contact with not-shown aluminum. Here, the N-type well area 703 used as a resistor becomes a terminal of a diode together with the high concentration P-type area 706*c* and is provided so as to connect the high concentration N-type area 705*a* directly connected to the pad and the high concentration N-type area 705*c* provided apart from the high concentration N-type area 705*a*. The high concentration N-type area 705*c* is connected to the high concentration P-type area 706*c* provided in the P-type well area 702 via the not-shown aluminum. Consequently, the N-type well area 703 constitutes the diode together with the P-type silicon substrate 701 and the P-type well area 702 and acts as a resistor between the high concentration N-type area 705*a* and the high concentration N-type area 705*c*. FIG. 7B is the same as FIG. 7A except that the pull-down resistor is changed to the pull-up resistor because the high concentration N-type area 705*c* is replaced with the high concentration N-type area 705*b*. Thus, in FIG. 7B, the identical layers are denoted by the identical reference symbols, and repeated descriptions of the layers will be omitted. In FIG. 7C, the diode is constituted by the N-type well area 703, the high concentration P-type area 706*a*, and the high concentration N-type area 705*b*. In FIG. 7D, the diode is constituted by the N-type well area 703, the P-type well area 702, the high concentration P-type area 706*c*, and the high concentration N-type area 705*a*.

In a drive sequence of recording using this head substrate, first, image data is serially sent to a substrate inside a head from a printer main body in synchronization with clock, and a shift register 404 in the substrate captures the image data. The captured data is temporarily stored in the latch circuit. Block selections are performed in a time division manner until the next image data is held by the latch circuit 403. When a heat pulse is inputted from a heat pulse input pad 411 upon each of the block selections, one or more power transistors 402, for which block selection is performed and image data is ON, are turned ON, and a current (drive pulse) flows to one or more heating elements 401, for which the block selection is performed and image data is ON, to drive the heating elements 401.

Moreover, in this embodiment, a delay circuit group 102 is provided such that heating elements are driven at staggered timing even if the heating elements belong to an identical block, and heat pulses with different delay times are generated based upon a heat pulse inputted from the heat pulse input pad 411 and supplied to the different heating elements 401 in the same block. That is, the delay circuit group 102 has several logic circuits 104 in which inverter circuits are connected serially in an even number stages, and with respect to heating elements of the number found by deducting one from the number of heating elements included in the identical block, outputs heat pulses corresponding to the respective heating elements onto respective heat pulse signal lines 103 corresponding to those heating elements. In the illustrated example, it is assumed that one block is constituted by four heating elements 401, which are represented by A to D for the convenience's sake. The heat pulse inputted from the heat pulse input pad 411 is directly supplied to the heating element A. The heat pulse inputted from the heat pulse input pad 411 is supplied to the heating element B via one logic circuit 104. A heat pulse, which is obtained by further delaying the heat pulse to be supplied to the heating element B with one logic circuit 104, is supplied to the heating element C. A heat pulse, which is obtained by further delaying the heat pulse to be supplied to the heating element C with one logic circuit 104, is supplied to the heating element D. After all, heat pulses, which are obtained by delaying the heat pulse inputted in the heat pulse input pad 411 with the logic circuit 104 of one stage, two stages, and three stages, respectively, are supplied to the heating elements B, C, and D.

Figure 2A:
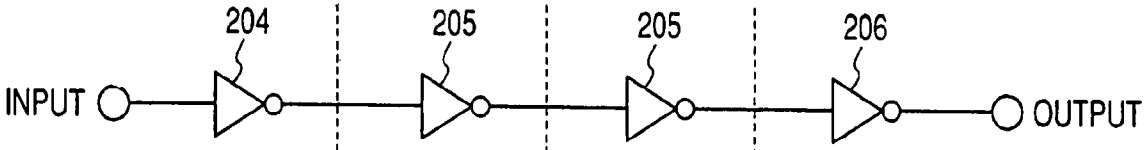
FIGS. 2A and 2B are circuit diagrams showing an example of a structure of an inverter delay circuit in the ink jet head substrate shown in FIG. 1.
Figure 2B:
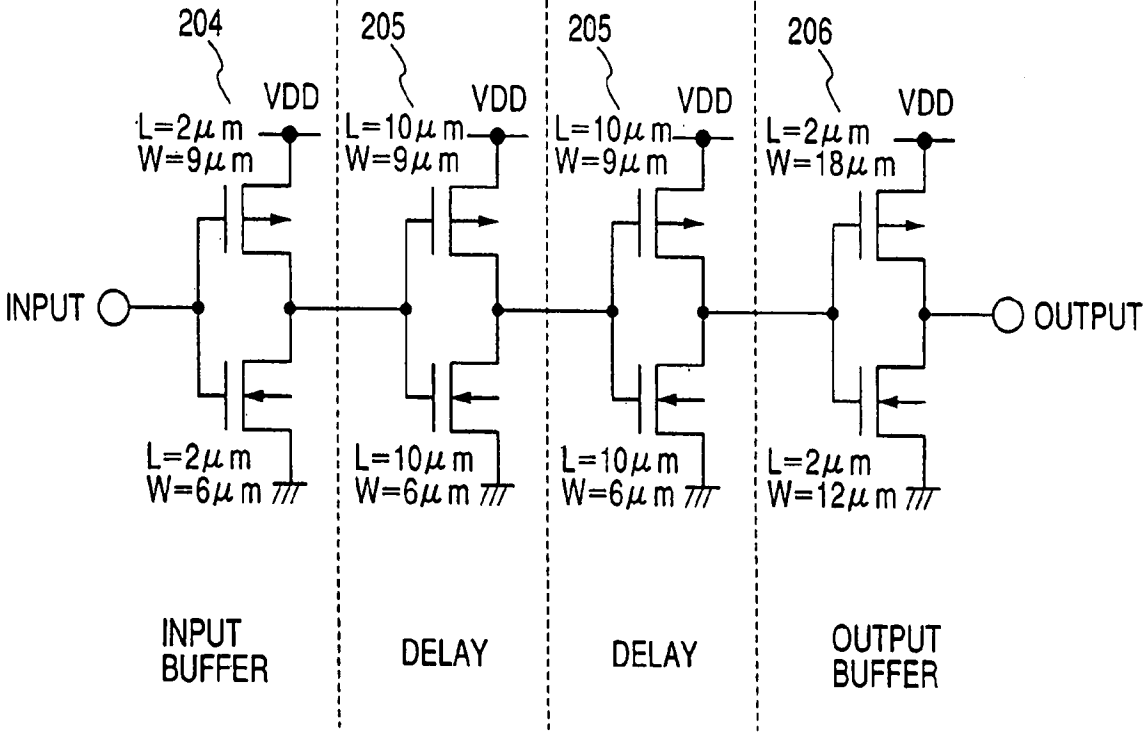

As such a logic circuit 104, an inverter delay circuit constituted by combining a plurality of inverter circuits, which are constituted by an identical film forming process of the logic system of the drive control system including the shift register 404 and the latch circuit 403, can be used. FIGS. 2A and 2B show an example of the logic circuit 104 provided as the delay circuit. FIG. 2A shows the logic circuit 104 at a block level, and FIG. 2B shows the circuit in more detail at a gate level.

As shown in FIG. 2A, the logic circuit 104 is constituted by an input buffer 204, cascaded two-step delays 205, and an output buffer 206. Here, all of the input buffer 204, the delays 205, and the output buffer 206 are complementary metal oxide semiconductor (CMOS) inverter circuit. Since the delays 205 are provided in two stages, after all, this logic circuit 104 is a circuit constituted by cascading four-stage inverter circuits.

In this delay circuit, as shown in FIG. 2B, in the input buffer 204 and the output buffer 206, a gate length (channel length) L of each MOS transistor (p channel and n channel) constituting inverters thereof is set to 2 μm which is identical with that of the logic system of the drive control system including the shift resistor 404 and the latch circuit 403. In addition, a gate length L in the delays 205 is set to 10 μm, which is longer than 2 μm in the logic system, such that sufficient delay can be obtained. Note that a gate width (channel width) W in the delays 205 is set to the same value as that in the input buffer 204 (e.g., 6 μm for n-MOS, 9 μm for p-MOS). A gate width W of the output buffer 206 is set to 12 μm for n-MOS and 18 μm for p-MOS.

In this embodiment, assuming that a block is formed by four heating elements 401, three delay circuits 104 are provided for a signal line portion of the heat pulse from the heat pulse input pad 411 to constitute four types of heat pulse signal lines 103 which are wired such that a time required for a heat pulse to actually travel among the four heating elements simultaneously selected by the block selection circuit 405 is staggered by 10 ns for each element. Here, operations of this embodiment will be described assuming that all the heating elements A to D in FIG. 1 are selected and driven, that is, assuming that, in the case in which all signals applied to these heating elements from the latch 403 are active (enable) and a heat pulse is at a high level, the power transistor 402 is turned ON and a current flows to the heating element 401 as a drive pulse.

The heating element A is driven by a heat pulse which is unchanged from that inputted in the heat pulse input pad 411, and a waveform obtained by delaying the heat pulse to be applied to the heating element A becomes a heat pulse to be applied to the heating element B. In this case, a time when the heat pulse actually exceeds a threshold value of the power transistor 402 to cause a current to start flowing to the heating element B (turn on the heating element B) is delayed to be later than a time when a current starts to flow to the heating element A. Similarly, since a time when a current starts to flow to the heating element C and a time when a current starts to flow to the heating element D are sequentially delayed as well, a current pulse flowing to the heating element drive power supply line changes to a step shape. That is, an amount of current change per unit time does not differ much from that in the case in which a single heating element is turned ON, and a noise level is significantly reduced.

Compared with the head substrate described in U.S. Pat. No. 6,243,111, in the head substrate of this embodiment, a heat pulse is delayed not by a CR integrating circuit but by a logic circuit such as a CMOS inverter. Thus, fluctuation of a delay amount is reduced, and a current applied to a heating element can be controlled with high accuracy. Therefore, an amount of noises generated can be further suppressed. Moreover, since the CMOS inverter circuit can be manufactured in a size smaller than the CR integrating circuit on a silicon semiconductor substrate, the head substrate of this embodiment can be made smaller than the conventional one, which leads to reduction in cost and improvement in productivity.

Note that, in this embodiment, the case in which block selection is performed for four heating elements simultaneously and a heat pulse transmission time is staggered for each heating element is illustrated. However, the number of heating elements constituting one block can be appropriately decided, and several heating elements may be combined within a range in which a noise level does not become a problem to apply heat pulses to the heating elements at the same timing. It goes without saying that the present invention can be applied to a case in which any number of heating elements are simultaneously turned ON by increasing or decreasing an amount of delay according to an inverter delay circuit and conducting wiring appropriately.

The above-mentioned inverter delay circuit 104 can be manufactured simultaneously with the head substrate 400 without changing a process for manufacturing the head substrate 400 by forming the drive control logic system, the pulse width input unit (pad 411), the block selection circuit 405, and the like, all of which include heating elements, a driver (power transistor), a shift resistor, and a latch circuit on a silicon semiconductor substrate, with a film forming process. Therefore, since it is unnecessary to largely change the number of pads of the input unit of the substrate and other circuit components in the substrate, even if the delay circuit group 102 is provided as described above, cost for the substrate itself is hardly increased. In addition, since it is possible to cope with noises in the head, it becomes unnecessary to attach a component such as a capacitor for countermeasure for noises to other parts. Therefore, reduction in cost and miniaturization of the apparatus main body are realized.

Figure 3:
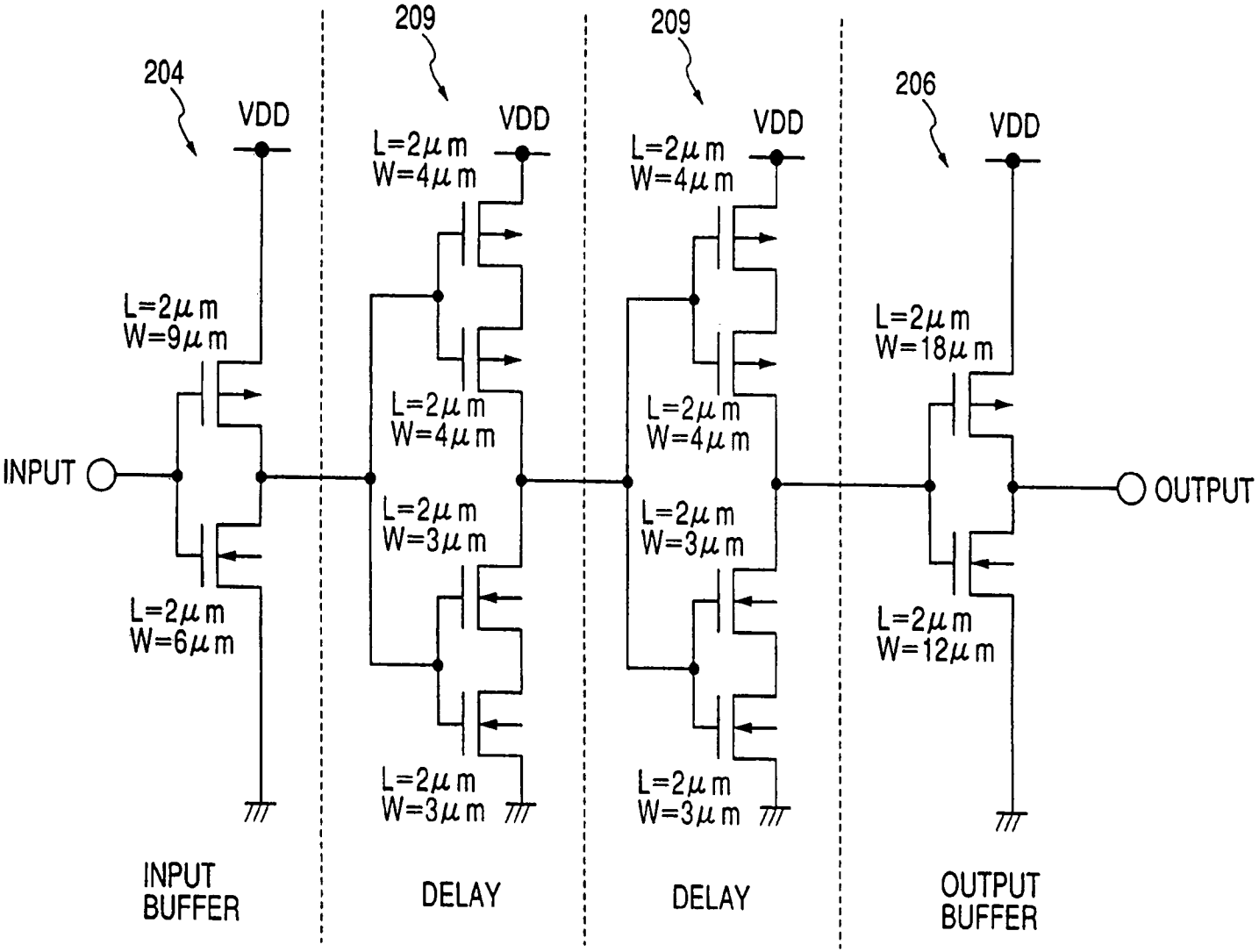
FIG. 3 is a circuit diagram showing another example of a structure of the inverter delay circuit in the ink jet head substrate shown in FIG. 1.

In the present invention, the delay circuit 104 for delaying a heat pulse is not limited to those shown in FIGS. 2A and 2B. FIG. 3 shows another example of the delay circuit.

The delay circuit shown in FIG. 3 is provided with the input buffer 204, two-stage delays 209, and the output buffer 206 which is composed of a CMOS inverter circuit, respectively, as in the delay circuit of FIGS. 2A and 2B. However, the delays 209 are different from the delays shown in FIGS. 2A and 2B. That is, in the delay circuit shown in FIG. 3, the delays 209 serving as CMOS inverter circuits are circuits in which, in order to increase a delay amount, an N-channel MOS transistor in a usual CMOS inverter circuit (see FIGS. 2A and 2B) is replaced with two cascaded N-channel MOS transistors, and a P-channel MOS transistor is replaced with two cascaded P-channel MOS transistors. An output of the inverter at the pre-stage is commonly supplied to a gate of each MOS transistor.

With this structure, a sufficient delay time can be obtained without increasing a gate (channel) length L in each MOS transistor. In particular, since it is easy to make the gate length L in each MOS transistor constituting the delay circuit the same as a gate length in the transistor of logic system of the drive control system including the shift register 404 and the latch circuit 403, there is an advantage that circuit design and layout design of the head substrate as a semiconductor device or an integrated circuit become easy.

Figure 4:
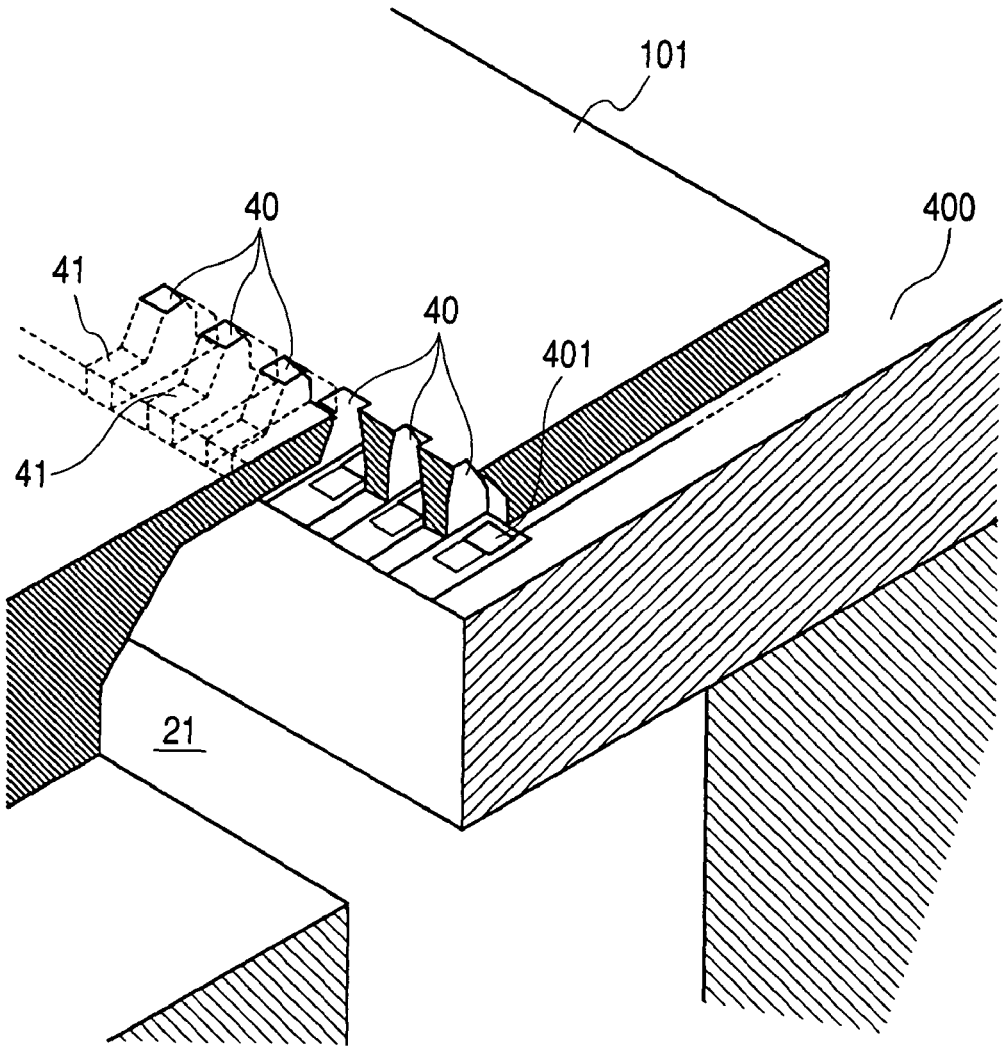
FIG. 4 is a schematic diagram of an ink jet head using the substrate shown in FIG. 1.

Next, a schematic structure of an ink jet head of the present invention using the above-mentioned head substrate will be described with reference to FIG. 4.

As described above, a plurality of heating elements (heaters) for receiving an electric signal to generate heat and discharge ink from discharge ports 40 with bubbles generated by the heat are arranged in an array on the head substrate 400.

Flow paths 41 for supplying ink to the discharge ports 40 are provided in position opposed to the heating elements and in association with the respective discharge ports. Walls constituting these discharge ports and flow paths are provided in grooved members 101, and these grooved members 101 are connected to the head substrate 400, whereby the plurality of flow paths 41 and a common liquid chamber 21 for supplying ink to the flow paths 41 are provided.

Figure 5:
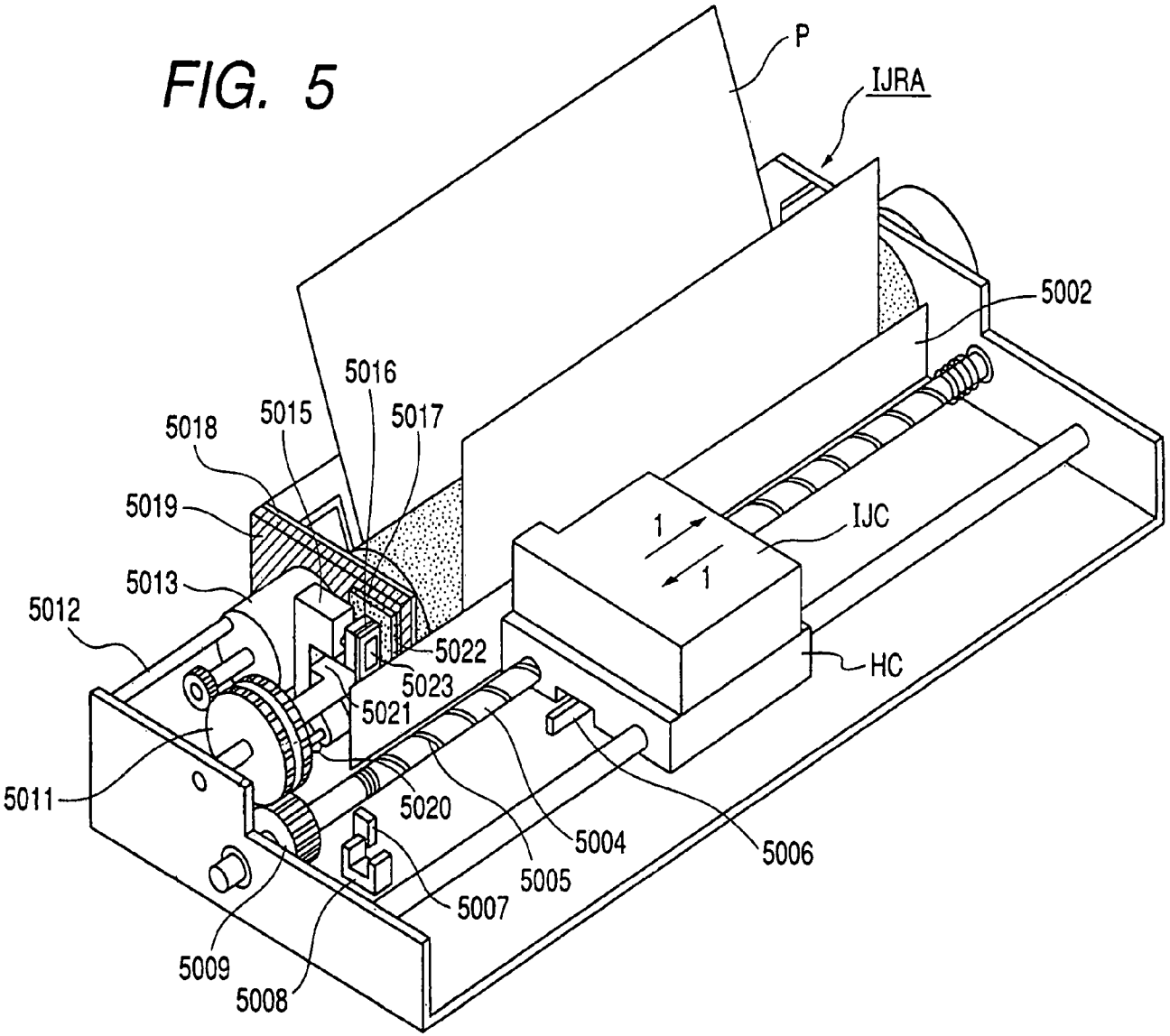
FIG. 5 is a perspective view showing an example of a structure of an ink jet print apparatus using the ink jet head shown in FIG. 4.

FIG. 5 is a schematic view of an ink jet print apparatus IJRA to which the ink jet head of the present invention is applied. A carriage HC engaged with a spiral groove 5004 of a lead screw 5005, which rotates via driving force transmission gears 5011 and 5009 in association with forward and backward rotations of a drive motor 5013, is a carriage on which the ink jet head is detachably mounted, and has a pin (not shown), and is reciprocatingly moved in directions of an arrow a and an arrow b. Reference numeral 5002 denotes a paper holding plate, which presses a print medium, typically paper, to a platen serving as print medium conveying means over a carriage moving direction. Reference numerals 5007 and 5008 denote home position detection means which confirm the existence of a lever 5006 of the carriage in this area with a photo coupler to perform rotating direction switching or the like of the motor 5013. Reference numeral 5016 denotes a member for supporting a cap member 5022 which caps the front surface of the ink jet head. Reference numeral 5015 denotes suction means which sucks the inside of this cap and performs suction recovery of the ink jet head via an opening 5023 in the cap. Reference numeral 5017 denotes a cleaning blade and 5019 denotes a member for making this blade movable back and forth, both of which are supported by a main body support plate 5018. It goes without saying that instead of the blade of this form, a well-known cleaning blade can be applied to this embodiment. In addition, reference numeral 5012 is a lever for starting suction of suction recovery, which moves in accordance with the movement of a cam 5020 engaged with the carriage. A driving force from a drive motor is switched by publicly known transmission means such as clutch switching or the like to control the movement of the lever.

These capping, cleaning, and suction recovery are adapted such that, when the carriage comes to a home position side area, desired processing can be performed in positions corresponding to the capping, the cleaning, and the suction recovery by the action of the lead screw 5005. Provided that a desired operation is performed at well-known timing, any of them can be applied to this embodiment. Each structure in the above description is an excellent invention individually or in combination, and represents a preferable example of structure for the present invention.

Note that signal supply means, which supplies a drive signal for driving heating elements and other signals to the ink jet head (head substrate), is provided in this apparatus.

What is claimed is:

1. An ink jet head substrate having a plurality of heating elements and an input line for inputting a pulse width regulating signal regulating a width of a drive pulse to be applied to the heating elements on a base substrate, wherein a logic circuit for supplying the drive pulse to be applied to the heating elements at staggered timing is provided on the input line for inputting the pulse width regulating signal, and wherein the input line is provided with an electrostatic protective element comprising (a) a pull-down resistor or a pull-up resistor, either of which having a parasitic diode for electrostatic protection between around lines; (b) a diode for electrostatic protection connected to a ground line; (c) at least two diodes for electrostatic protection connected to a logic circuit drive power supply; and (d) a polysilicon resistor.

2. The ink jet head substrate according to claim 1, further comprising:

a driver which drives the plurality of heating elements according to image data;

a block selection unit for dividing the plurality of heating elements into blocks for a predetermined number of heating elements to drive the heating elements in a time division manner with the divided block as a unit;

a drive control logic which controls a drive signal to be given to the driver; and a hysteresis circuit which is provided in an input portion of the drive control logic and makes an input data threshold value different at rising and falling.

3. The ink jet head substrate according to claim 1, wherein the logic circuit comprises CMOS inverters of even number stages connected serially.

4. The ink jet head substrate according to claim 1, wherein a shift register for outputting image data, which is inputted serially, in parallel, and a latch circuit temporarily storing data outputted from the shift register are further provided on the substrate, wherein the heating elements, the driver, the input line, the block selection unit, the shift register, and the latch circuit are formed on the substrate, and wherein the logic circuit has a form of an inverter circuit which is formed by a film forming process identical with that for a drive control logic system including the shift register and the latch circuit.

5. The ink jet head substrate according to claim 4, wherein the inverter circuit is a CMOS inverter circuit.

6. An ink jet head comprising:

the ink jet head substrate according to claim 1; and a member which is combined with the ink jet head substrate and forms liquid paths relating to the heating elements and ink discharge ports forming one end of the liquid paths.

7. An ink jet print apparatus comprising:

the ink jet head according to claim 6; and means for conveying a print medium relatively to the ink jet head.

8. The ink jet print apparatus according to claim 7, further comprising a carriage which detachably supports the ink jet head and causes the ink jet head to scan the print medium.

* * * * *

UNITED STATES PATENT AND TRADEMARK OFFICE

CERTIFICATE OF CORRECTION

PATENT NO. : 7,021,748 B2
APPLICATION NO. : 10/619577
DATED : April 4, 2006
INVENTOR(S) : Yasuo Fujii et al.

It is certified that error appears in the above-identified patent and that said Letters Patent is hereby corrected as shown below:

COLUMN 1

Line 63, “concerned.” should read --a concern.--.

COLUMN 3

Line 32, “features” should read --features and--.

COLUMN 4

Line 6, “which” should read --which is--; and
Line 10, “One” should read --Some--.

COLUMN 8

Line 37, “provided.” should read --provided. ¶ Next, an ink jet print apparatus using such an ink head will be described.--.

COLUMN 9

Line 28, “around” should read --ground--.

Signed and Sealed this

Seventeenth Day of October, 2006

JON W. DUDAS
*Director of the United States Patent and Trademark Office*